US007753717B2

(12) United States Patent
Belopolsky et al.

(10) Patent No.: US 7,753,717 B2
(45) Date of Patent: Jul. 13, 2010

(54) HIGH SPEED DATA PLUG AND METHOD FOR ASSEMBLY

(75) Inventors: Yakov Belopolsky, Harrisburg, PA (US); Brian Bentley, York, PA (US); David Gutter, Felton, PA (US); Richard Marowsky, York, PA (US); Steven Weller, Camp Hill, PA (US)

(73) Assignee: Bel Fuse Ltd., San Po Kong, Kowloon (HK)

( * ) Notice: Subject to any disclaimer, the term of this patent is extended or adjusted under 35 U.S.C. 154(b) by 0 days.

(21) Appl. No.: 11/748,665

(22) Filed: May 15, 2007

(65) Prior Publication Data

US 2007/0270036 A1 Nov. 22, 2007

Related U.S. Application Data

(60) Provisional application No. 60/747,529, filed on May 17, 2006.

(51) Int. Cl.
*H01R 11/20* (2006.01)

(52) U.S. Cl. ..... 439/418

(58) Field of Classification Search ..... 439/418, 439/426, 425, 440
See application file for complete search history.

(56) References Cited

U.S. PATENT DOCUMENTS

| | | | | |
|---|---|---|---|---|
| 4,950,176 | A * | 8/1990 | Cocco et al. | 439/344 |
| 6,984,154 | B1 * | 1/2006 | Jee | 439/676 |
| 7,033,219 | B2 * | 4/2006 | Gordon et al. | 439/610 |
| 7,220,149 | B2 * | 5/2007 | Pharney | 439/676 |

* cited by examiner

*Primary Examiner*—Neil Abrams
*Assistant Examiner*—Phuong Nguyen
(74) *Attorney, Agent, or Firm*—Cozen O'Connor

(57) ABSTRACT

A method and system for terminating a cable into a plug using a plug assembly system. Wires of the cable are exposed and dressed on to a shield. A plug body is placed over the shield. The wires are fed into wire insertion holes of the plug body. A contact holding member is placed on the plug body. A crimping tool crimps the contacts in the contact holding member through the plug body into and through the wires to achieve mechanical and electrical connection between the wires and the contacts. A cover may be used to cover the plug body, shield and wires. A crimp ferrule may be used to crimp the wires to the shield.

7 Claims, 12 Drawing Sheets

HIGH SPEED DATA PLUG AND METHOD FOR ASSEMBLY

This application claims priority to provisional application No. 60/747,529 entitled "HIGH SPEED DATA PLUG AND METHOD FOR ASSEMBLING SAME" filed May 17, 2006, the entirety of which is hereby incorporated by reference.

BACKGROUND OF THE INVENTION

The invention relates to a modular plug and, more particularly, to a modular plug design which can accommodate Category 7 communications and which may be easily assembled.

The use of modular plugs and jacks for data transmission is known. Basically, in order to establish electrical communication and a data path between a first and second device, the first device may send information in the form of electrical signals into a cable that terminates in a plug. The second device may include a jack. The plug and jack are designed so as to be easily mechanically mate-able in a male-female configuration. Once the plug and jack are mated, electrical members in the plug and jack engage and are electrically mated so that electrical information signals may travel from the first device to the second device.

This plug and jack design is limited by the physical configuration of the modular plug and jack. As data transmission speeds have increased, electrical performance relating to the transfer of electrical signals from plug to jack, has been affected. Each plug and jack frequently includes multiple pairs of contacts used to communicate information. Cross talk between these pairs (where electrical signals in one pair affect electrical signals in another pair) and interference from sources external to the plug-jack configuration, become more of a factor at higher speeds. In order to transmit higher speed data while minimizing signal degradation, the plug and jack design changed from prior designs to include extra shielding.

Standards organizations such as the Telecommunication Industry Association and the International Organization for Standardization publish standards regarding performance specifications and equipment configurations for plugs and jacks. Different levels or "categories" have been defined for use in twisted-pair cabling such as where a single insulated sheath includes two twisted wires. For example, "Category 6" plugs and jacks should be able to handle data communications with a frequency up to 250 MHz. Category 6 plugs and jacks typically have eight contacts aligned in a row on exclusively either a top or bottom of the plug or jack. More recent requirements, e.g. Category 7, require plugs and jacks which can communicate at speeds as high as 600 MHz. To handle these data communication speeds, Category 7 plugs are designed to have contact pairs on both the top and bottom of the plug body in contrast with the eight contacts all on either a top or bottom as in Category 6 plugs and jacks.

In practice, a technician terminates a cable having wires disposed therein, with a modular plug. When dealing with slower speed communication such as Category 6, where contacts are all aligned on a single side of a plug, assembly of such a plug to a cable was fairly simple. However, prior art methods for meeting the requirements of Category 7 standards for modular plugs requires use of complex contact formations, extensive shielding and multiple housing components. Further, in prior art techniques, contacts of the plug are mated with the wires in the cable through use of a small pyramidal shaped pin which is pushed through the respective insulated wires of the cable. Such a connection is not reliable in that over time the pin may recede from the wires, or wire strands of the wires may move and the contact forces between pin and wires can degrade resulting in high resistance, intermittent connections.

SUMMARY OF THE INVENTION

One embodiment of the invention is a method for assembling a plug, the method comprising exposing wires in a cable, dressing at least one of the wires on a top of a shield and placing a plug body over the shield. The method further comprises placing a contact holder including contacts over the plug body and crimping the contacts through the contact holder and the plug body into the wires.

Another embodiment of the invention is a plug assembly system comprising a contact holder including contacts and a plug body combinable with the contact holder, the plug body including recesses aligned with the contacts when the plug body is combined with the contact holder. The plug assembly system further comprises a shield having a top and a bottom and shaped so that the plug body may be placed over the shield.

BRIEF DESCRIPTION OF THE DRAWINGS

FIG. 12 is a bottom perspective view of a plug and cable terminated in accordance with an embodiment of the invention.

DETAILED DESCRIPTION OF THE PREFERRED EMBODIMENT(S)

Figure 1:
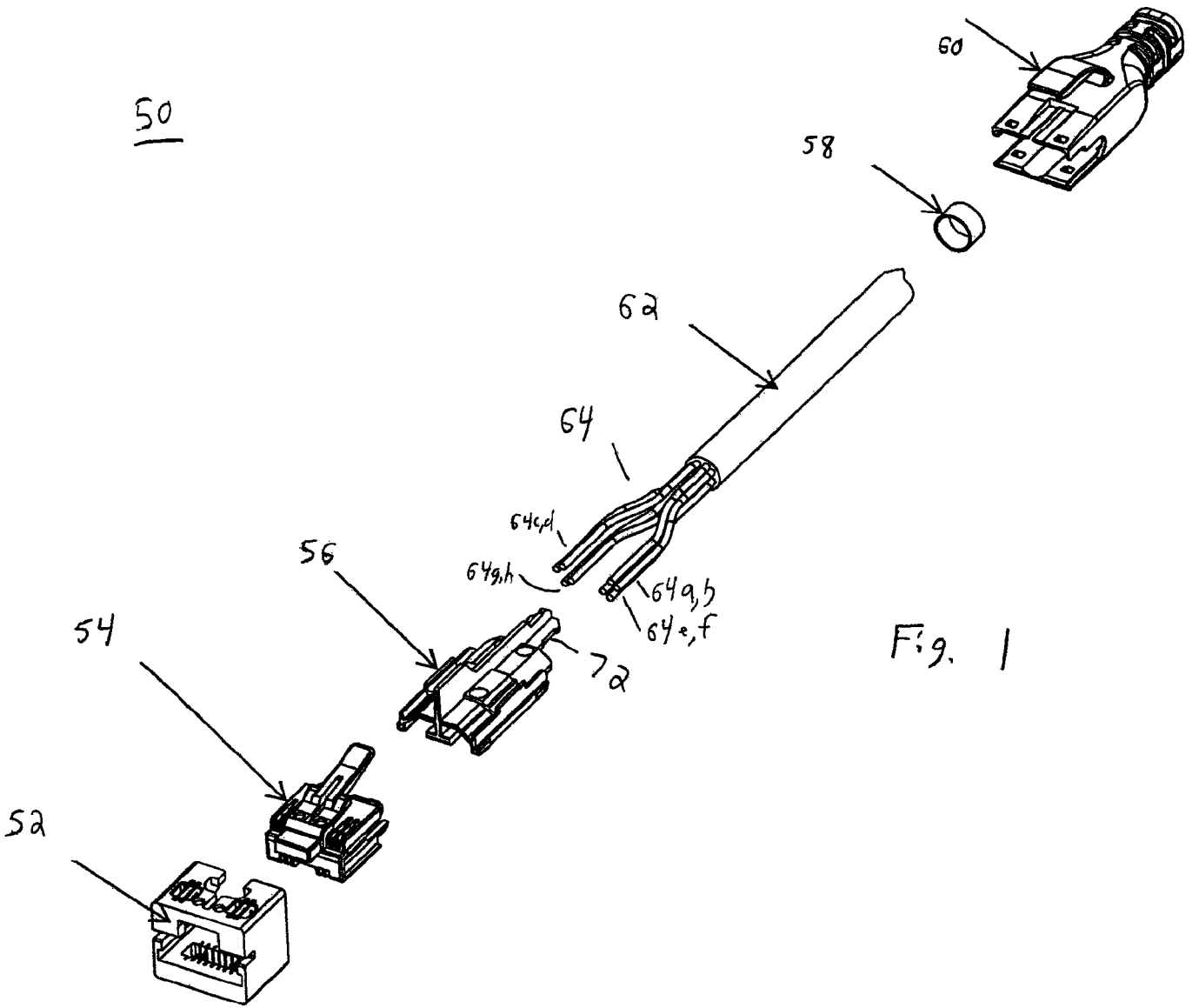
FIG. 1 is a top perspective view of a plug assembly system and cable in accordance with an embodiment of the invention.

Referring to FIG. 1, there is shown a modular plug assembly system 50 in accordance with an embodiment of the invention. Plug assembly system 50 includes a contact holder member 52, a plug body 54, a shield 56, a crimp ferrule 58 and a strain relief boot or cover 60. When a user desires to terminate a cable 62 with a plug using plug assembly system 50, the user first feeds strain relief boot 60 over an end of cable 62. The user then opens or strips an outer sheathing of cable 62 and removes any foil shields around wires 64 to expose wires 64. In the figures, eight (8) wires 64*a*, 64*b*, 64*c*, 64*d*, 64*e*, 64*f*, 64*g*, and 64*h* are shown.

Figure 2:
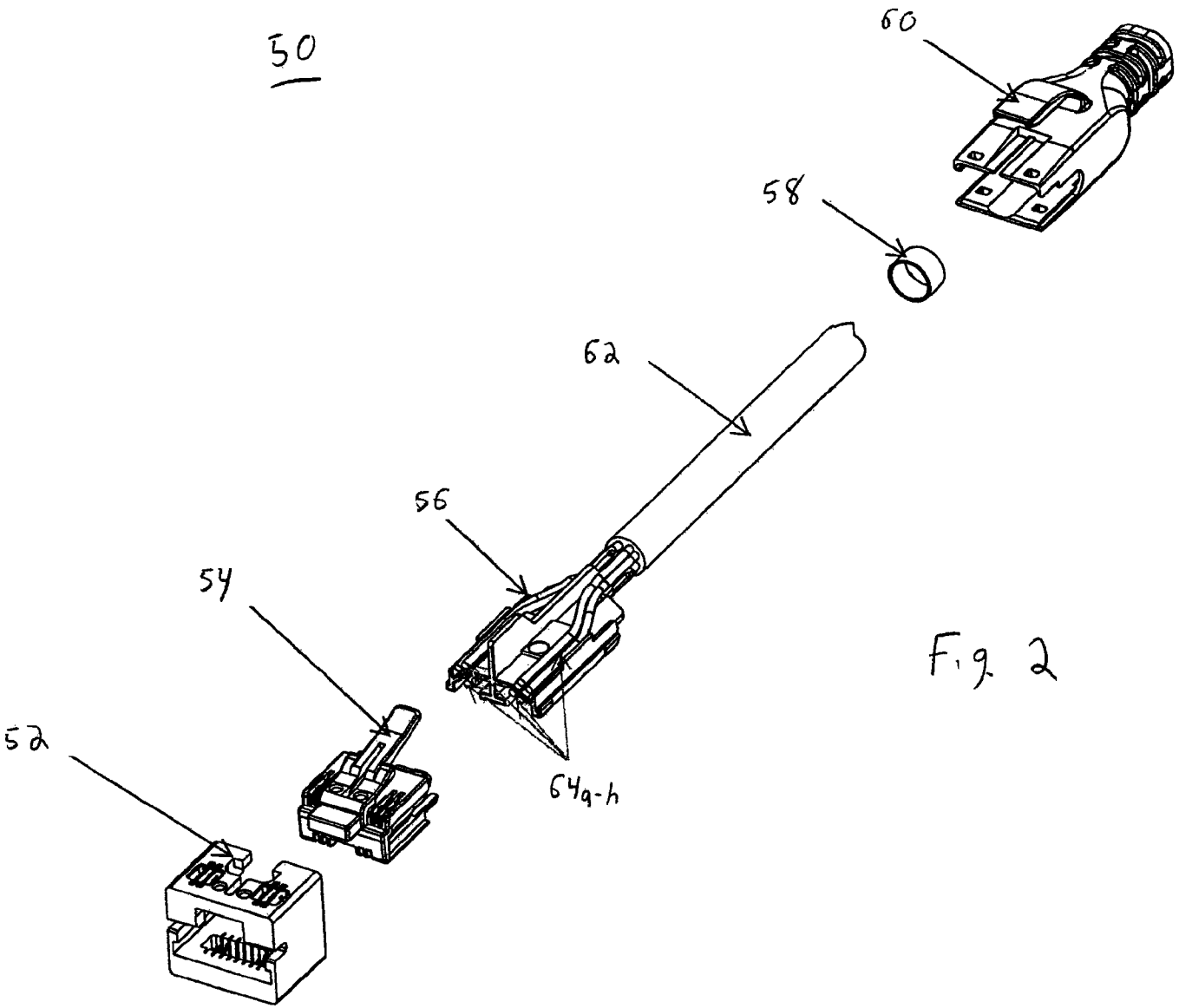
FIG. 2 is a top perspective view of a plug assembly system and cable in accordance with an embodiment of the invention.
Figure 3:
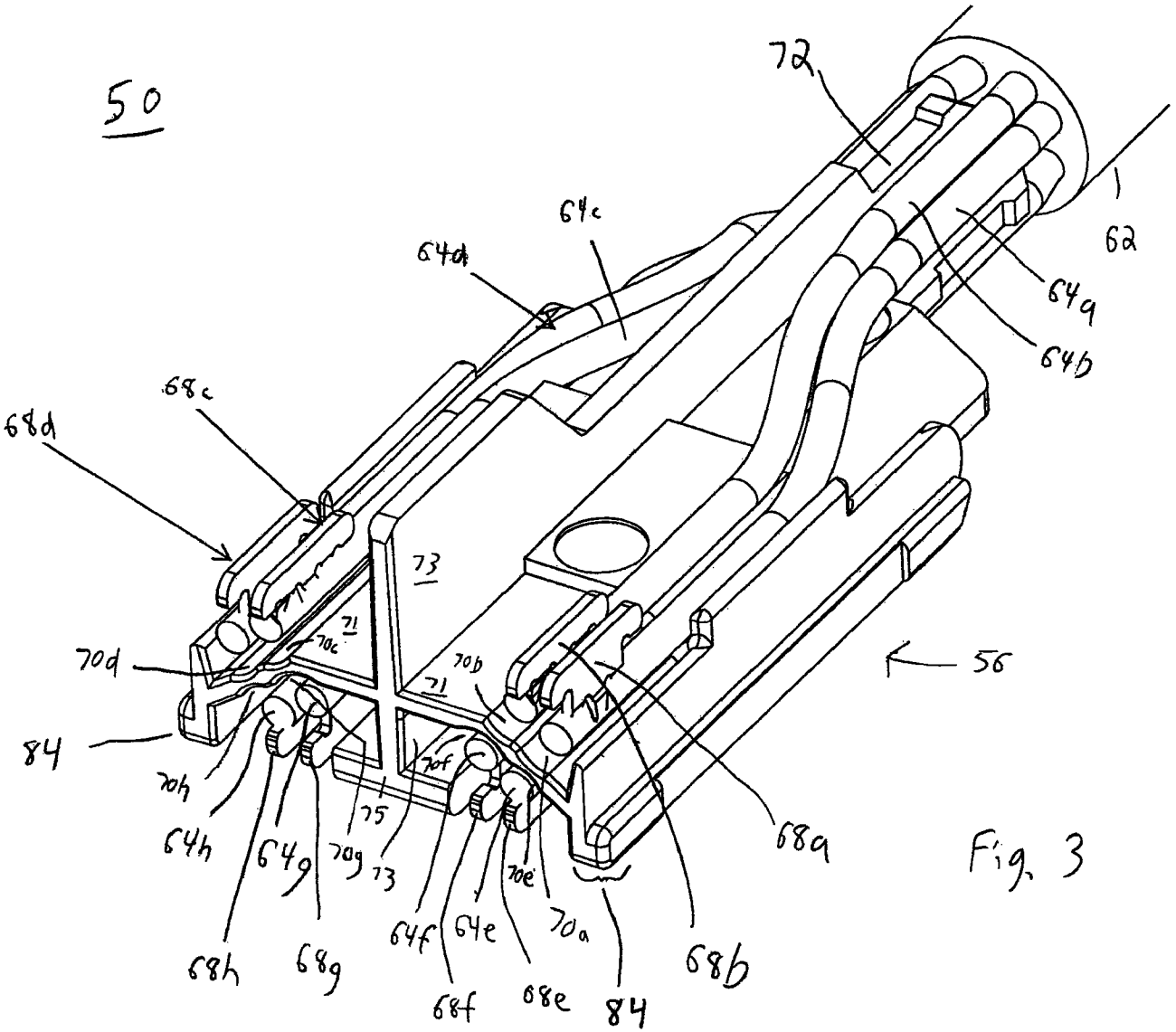
FIG. 3 is a top perspective cut-away view of wires dressed on a shield pierced with contacts in accordance with an embodiment of the invention.

Referring to FIGS. 2 and 3, in cable 62, each of four twisted wire pairs 64*a*, 64*b*; 64*c*, 64*d*; 64*e*, 64*f*; 64*g*, 64*h* are disposed in individually wrapped foil shields (not shown). Two pairs of wires 64*a*, 64*b* and 64*c*, 64*d* are straightened and dressed, in channels 70*a*, 70*b*, 70*c*, 70*d*, respectively, on the top side of shield 56. Similarly, wire pairs 64*e*, 64*f* and 64*g*, 64*h* are dressed in channels 70*e*, 70*f*, 70*g*, 70*h* on the bottom side of shield 56. Shield 56 may include a key 84 at distal ends used in plugs communicating with particular types of communication standards such as Category 6 communications.

Shield 56 is used to prevent crosstalk between respective pairs of wires. Referring to FIG. 3, the shield 56 includes a base 75, a post 72 (best shown in FIG. 1), vertical upwardly and downwardly extending ribs 73 (according to the orientation shown in the Figures) and horizontal leftwardly and rightwardly extending ribs 71 (according to the orientation shown in the Figures). Vertical upwardly extending rib 73 provides shielding against cross-talk between the pair of wires 64*a*, 64*b*, and the pair of wires 64*c*, 64*d* and vertical downwardly extending rib 73 provides shielding against cross-talk between the wire pair 64*e*, 64*f* and the wire pair 64*g*, 64*h*. Horizontal rightwardly extending rib 71 provides cross-talk shielding between wires 64*a*, 64*b* and the pair of wires 64*e*, 64*f* and horizontal leftwardly extending rib 71 provides cross-talk shielding between wire pair 64*c*, 64*d* and wire pair 64*g*, 64*h*. Base 75 further shields wires 64*e*, 64*f* from 64*g*, 64*h*. Shield 56, thus provides cross-talk shielding for virtually all portions of wires 64 not disposed within cable 62.

Horizontal leftwardly and rightwardly extending ribs 71 initially extend perpendicular to vertically extending ribs 73 and include portions that extend downwardly and leftwardly and downwardly and rightwardly respectively. Still referring to FIG. 3, pairs of channels 70*a*, 70*b* and 70*c*, 70*d* are formed in the top surfaces of the downwardly and leftwardly, and downwardly and rightwardly, extending portions of the horizontal ribs 71 respectively (according to the orientation shown in the Figures). Pairs of channels 70*e*, 70*f* and 70*g*, 70*h* are formed in the bottom surfaces of the downwardly rightwardly extending and downwardly leftwardly extending, portions of the horizontal ribs 71, respectively (according to the orientation shown in the Figures). The channels 70*a* and 70*b* are at different heights from one another, channels 70*c*, 70*d* are at different heights, channels 70*e*, 70*f* are at different heights, and channels 70*g*, 70*h* are at different heights. These differing heights mean that contacts 68 of different lengths are used.

Figure 4:
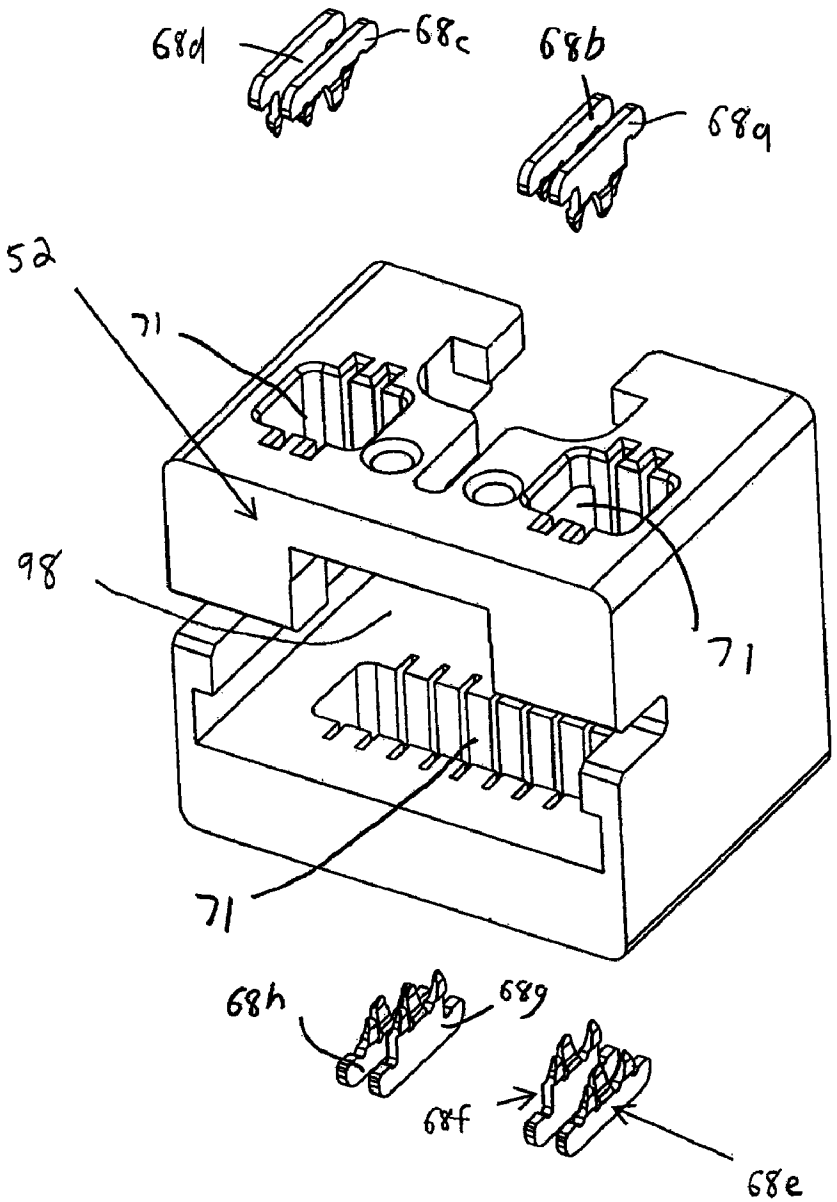
FIG. 4 is a top perspective exploded view of a contact holder and contacts in accordance with an embodiment of the invention.
Figure 5:
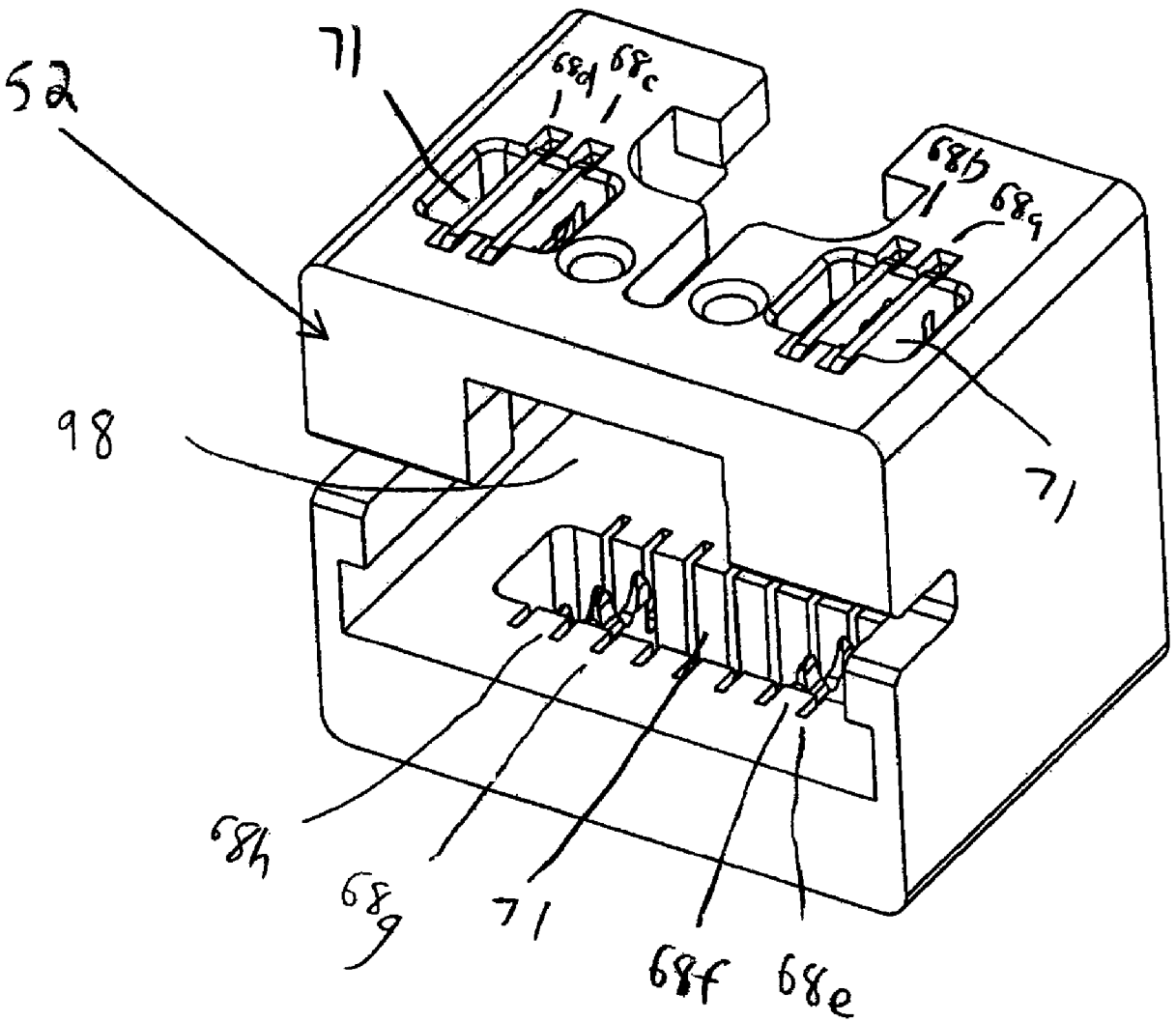
FIG. 5 is a top perspective view of a contact holder with contacts in accordance with an embodiment of the invention.

Referring to FIGS. 4 and 5, there is shown contact holder member 52 holding contacts 68. As discussed immediately above, contacts 68 have differing lengths so as to effectively mate with wires 64 disposed in channels 70 of differing heights. For example, contacts 68*a*, 68*d*, 68*f*, and 68*g* are longer than contacts 68*b*, 68*c*, 68*e*, and 68*h*. Clearly, shield 56 may be designed without such differing heights of channels or with channels heights having other configurations suggesting use of other contact lengths. Contact holder member 52 includes apertures 71 for receiving contacts 68 therein. Contact holder 52 may include a cut-out 98 effective to receive and mate with a protrusion or plug body 54 as in discussed below.

Figure 6:
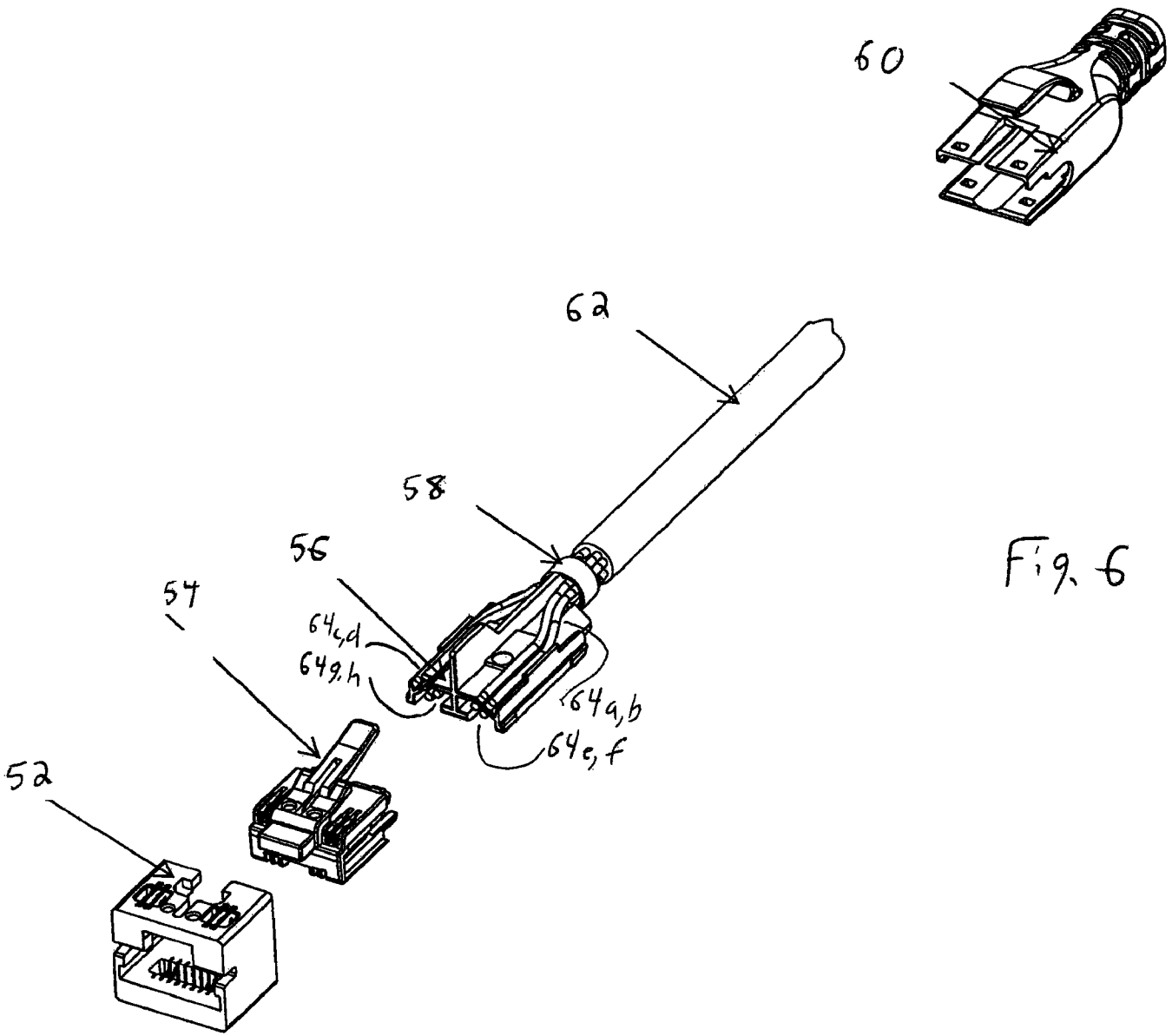
FIG. 6 is a top perspective view of a plug assembly system and cable in accordance with an embodiment of the invention.
Figure 7:
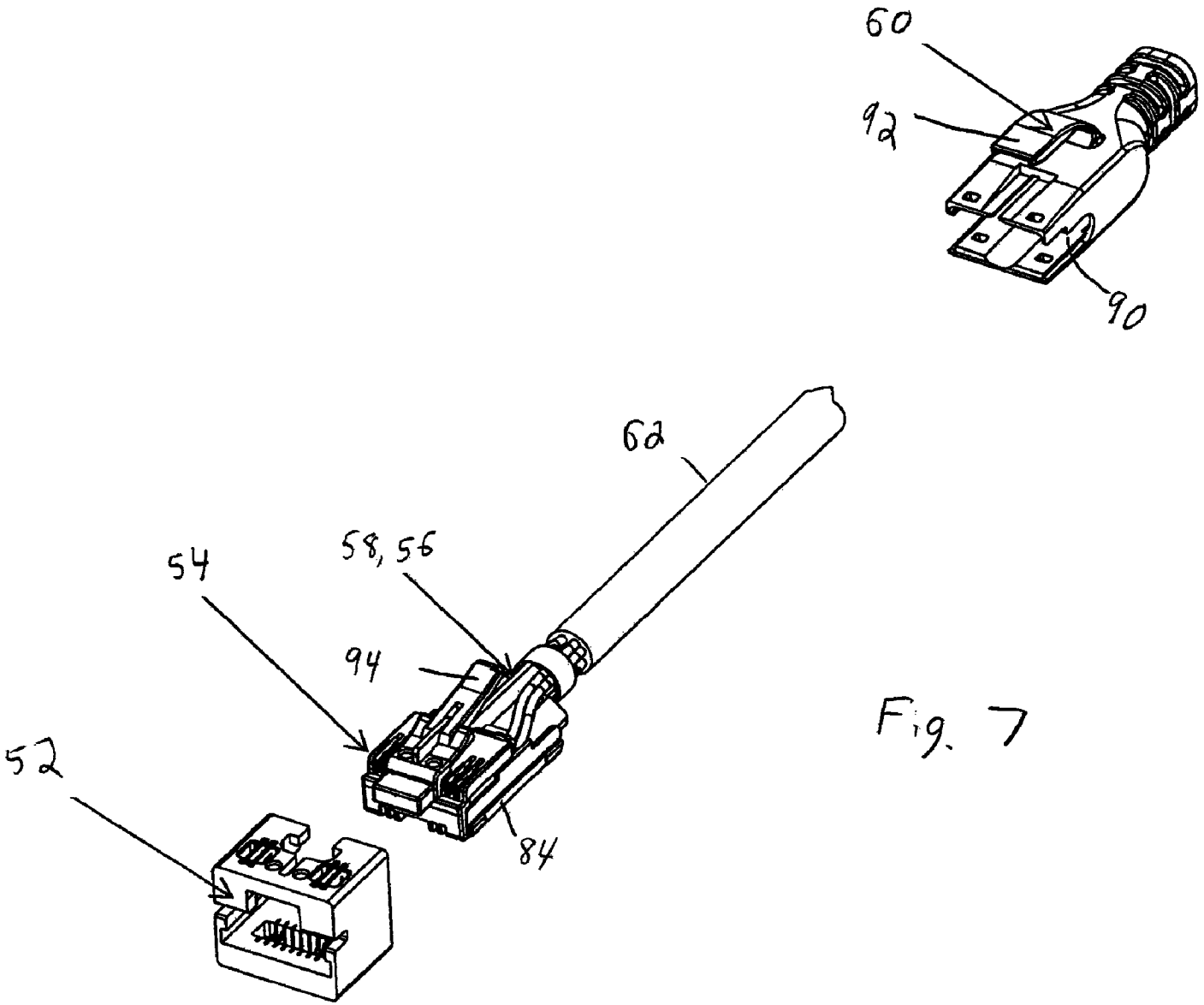
FIG. 7 is a top perspective view of a plug assembly system and cable in accordance with an embodiment of the invention.
Figure 8:
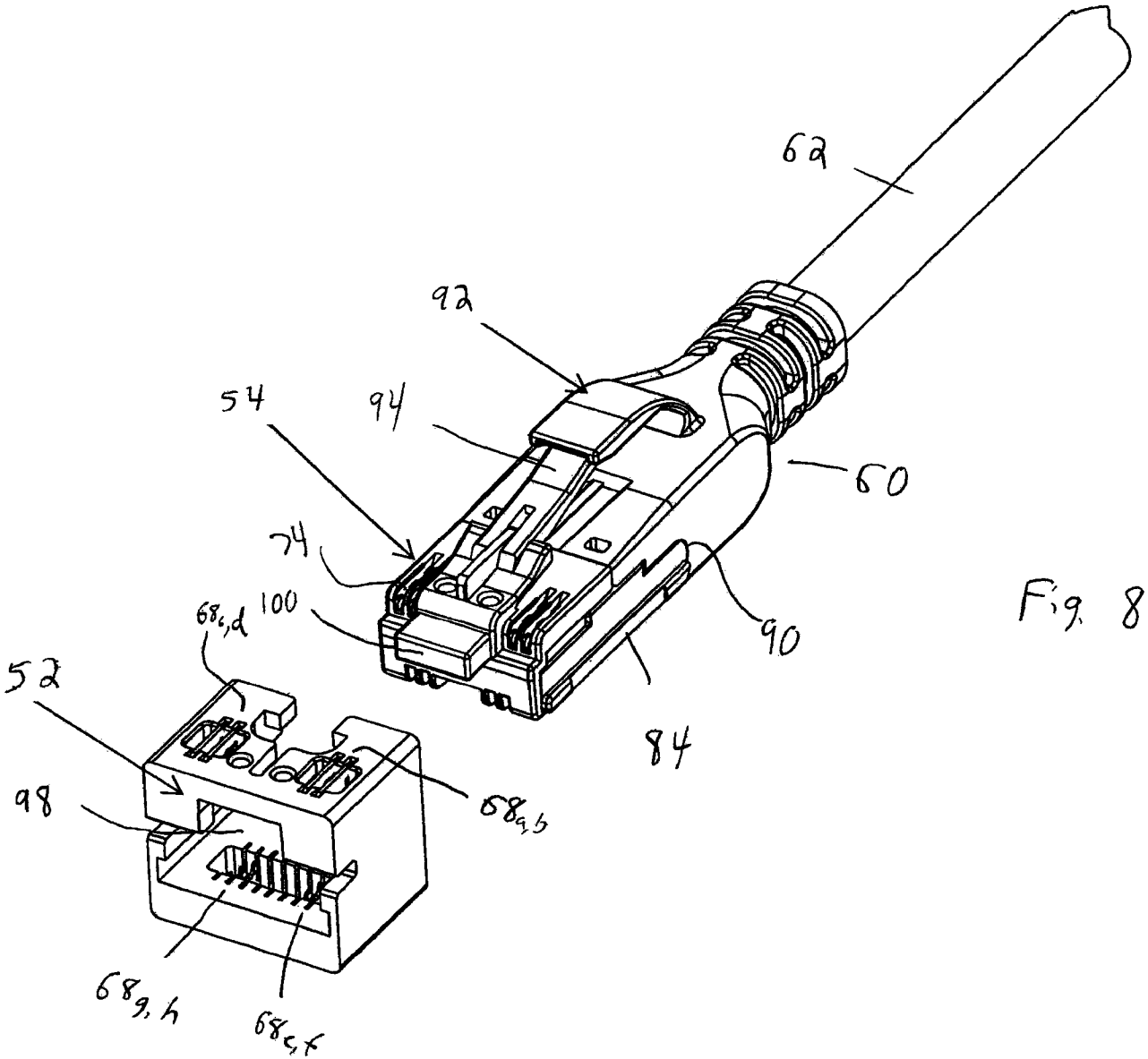
FIG. 8 is a top perspective view of a plug assembly system and cable in accordance with an embodiment of the invention.

Referring now to FIG. 6, when terminating a cable, wires 64 in cable 62 are dressed and cut off flush with an end of shield 56. Once wires 64 are dressed on shield 56, crimp ferrule 58 is crimped onto post 72 (FIG. 1) of shield 56 to secure wires 64 to shield 56. Thereafter, plug body 54 is placed over shield 56 as shown in FIG. 7. Wires 64 are inserted into wire insertion holes (not shown) of plug body 54. Cover 60 is then slid over plug body 54 (FIG. 8). As shown, a groove 90 on cover 60 mates with key 84 on plug body 54. Further, a latch 92 on cover 60 engages a tab 94 on body 54 so as to facilitate secure engagement between cover 60 and body 54. Tab 94 also provides mechanical engagement between plug 50 and a jack (not shown). Depressing latch 92 releases tab 94 from the jack.

Figure 9:
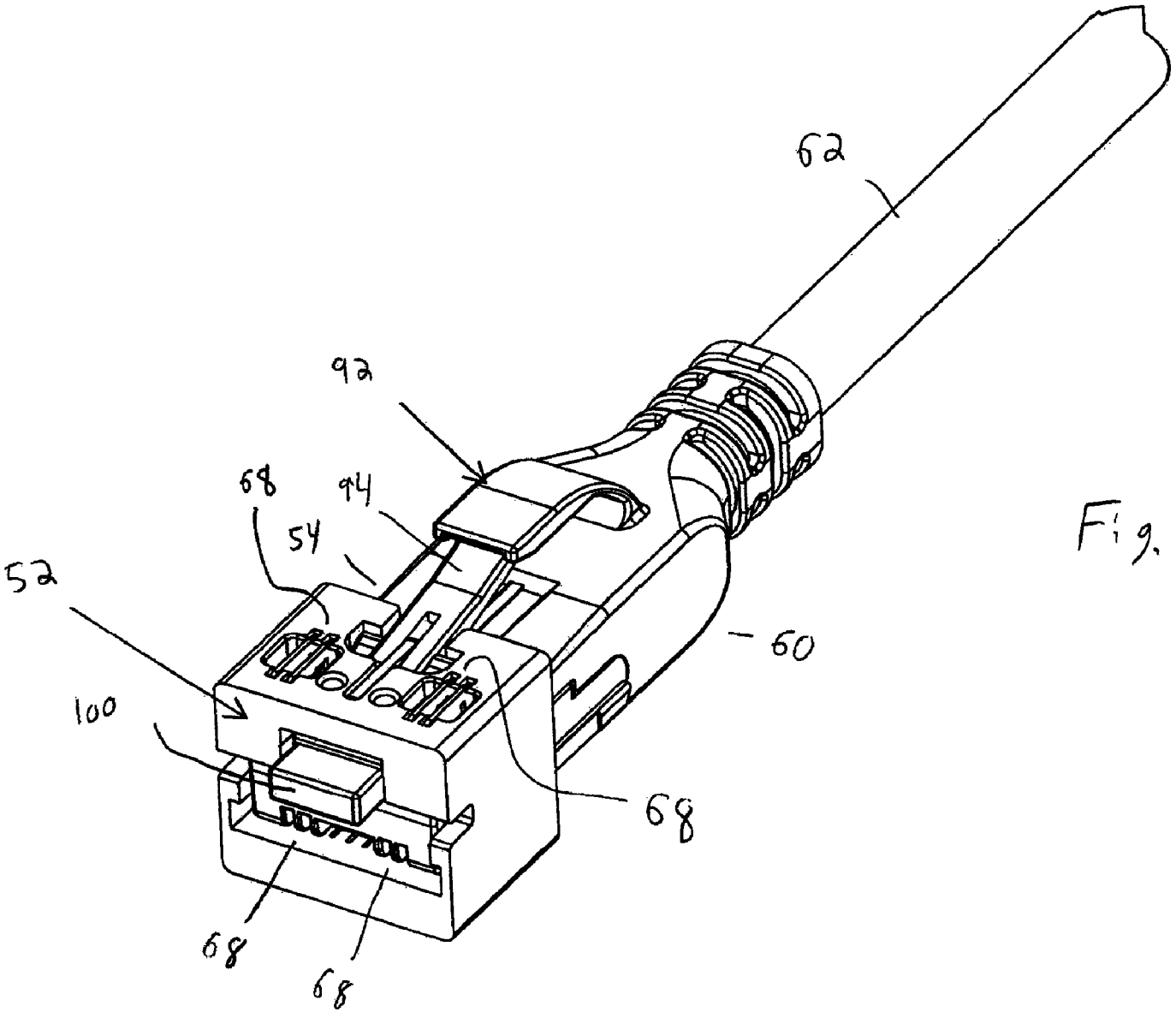
FIG. 9 is a top perspective view of a plug assembly system and cable in accordance with an embodiment of the invention.
Figure 11:
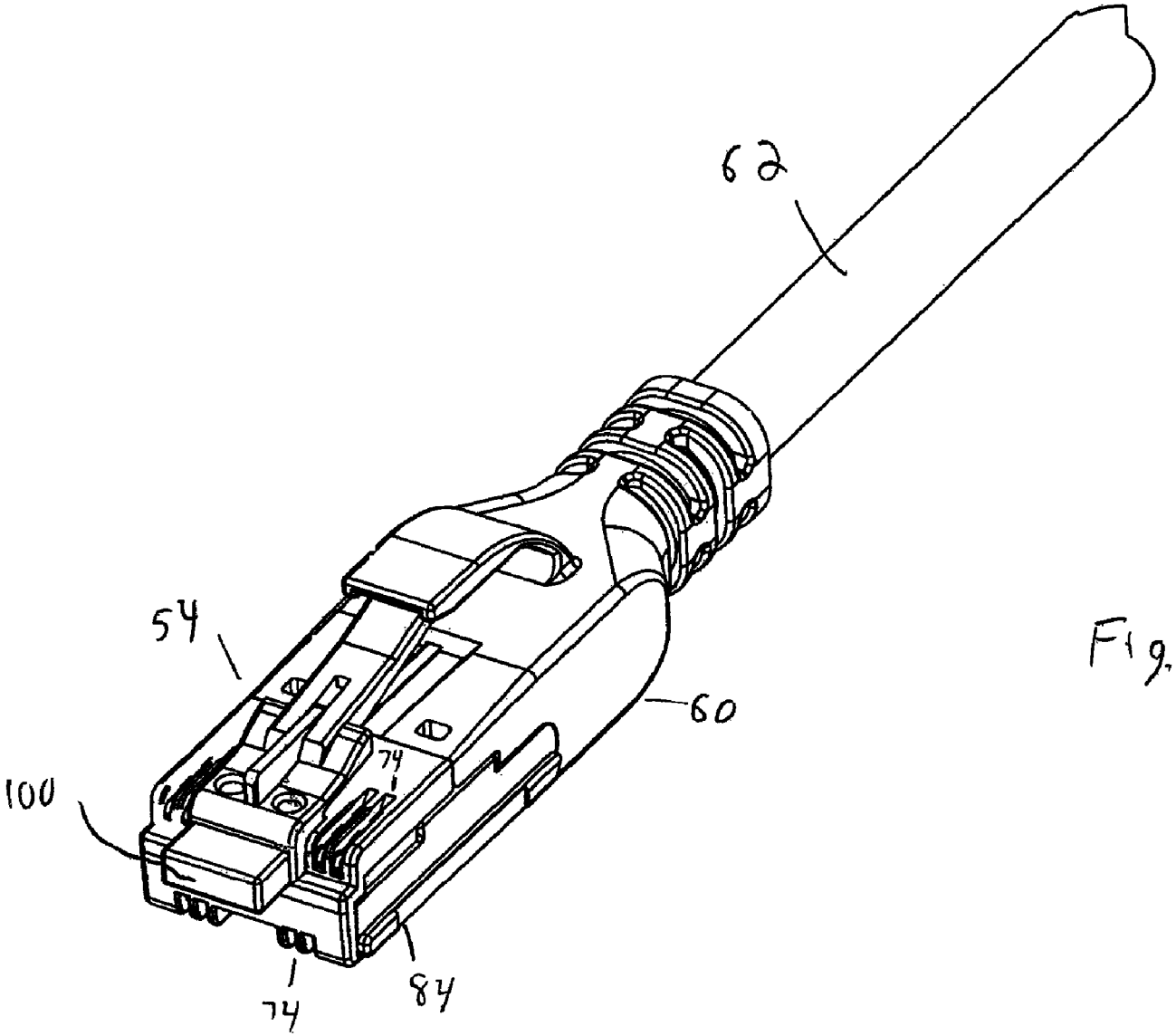
FIG. 11 is a top perspective view of a plug and cable terminated in accordance with an embodiment of the invention.
Figure 10:
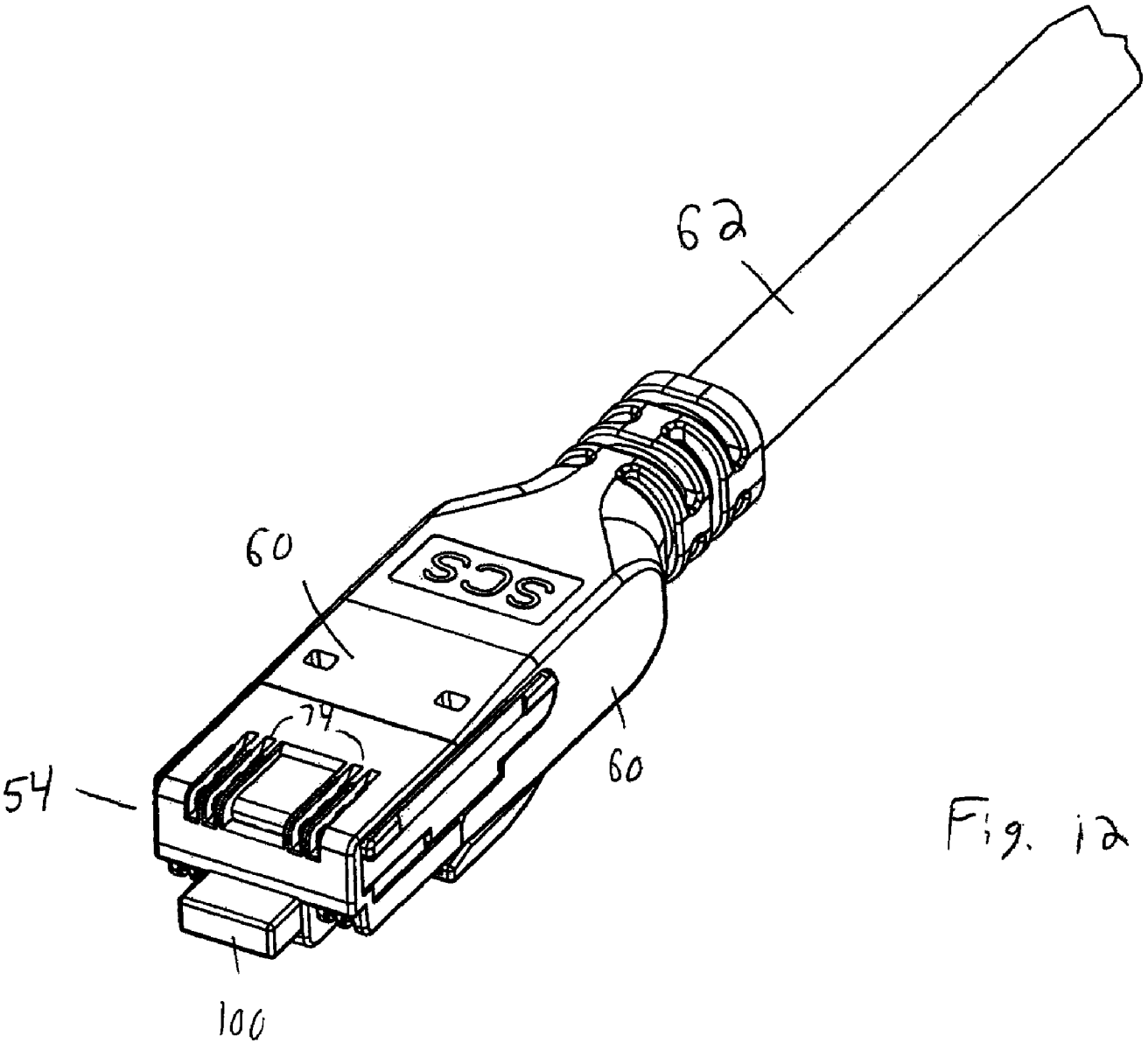

Referring to FIGS. 8 and 9, contact holder member 52, retaining pre-inserted contacts 68, is then placed over plug body 54 and the combination of these two elements is then assembled over wires 64 and shield 56. The contact holder member 52 includes, according to the orientation shown in the Figures, a body having a top and a bottom, four contacts 68*a*, 68*b*, 68*c* and 68*d* movably retained in apertures 71 formed in the top of the holder members, two of the top contacts 68*a*, 68*b* retained in apertures 71 formed in a right side of the holder member body and two of the top contacts 68*c*, 68*d* retained in apertures 71 formed in a left side of the holder member body. Further, the holder member body has, according to the orientation shown in the Figures, four contacts 68*e*, 68*f*, 68*g* and 68*h* movably retained in the bottom of the holder member, two of the bottom contacts 68*e*, 68*f* retained in apertures 71 formed in a right side of the holder member body and two of the bottom contacts 68*g*, 68*h* retained in apertures 71 formed in left side of the holder member body. A protrusion 100 of plug body 54 mates with cut-out 98 of contact holder 52. As discussed, contact holder 52 includes eight (8) contacts 68*a*, 68*b*, 68*c*, 68*d*, 68*e*, 68*f*, 68*g*, 68*h* disposed on a top and a bottom of contact holder 52 respectively. Plug body 54 includes corresponding recesses or slots 74 (see FIG. 8) aligned with contacts 68 when contact holder 52 is placed over plug body 54. Specifically, as shown in FIGS. 8 and 11, the plug body 54 has a top and bottom (according to the orientation shown in the Figures) in which a plurality of contact recesses or slots 74 are formed. In the illustrated embodiment, four contact slots 74 are formed in the top of the plug body 54, two of which are formed on a left side of the plug body 54 and two of which are formed on the right side of the plug body 54 (according to the orientation shown in the Figures). Four contact slots 74 are also formed in the bottom of the plug body 54, two of which are formed on a left side of the plug body 54 and two of which are formed on the right side of the plug body 54 (according to the orientation shown in the Figures). Though eight contacts and recesses are shown, clearly any other number of contacts and recesses may be used. For example, if plug assembly system 50 is also to be used for a plug that is to be Category 6 compliant, 12 contacts may be used—4 on a top and 8 on a bottom or 8 on a top and 4 on a bottom.

Figure 10:
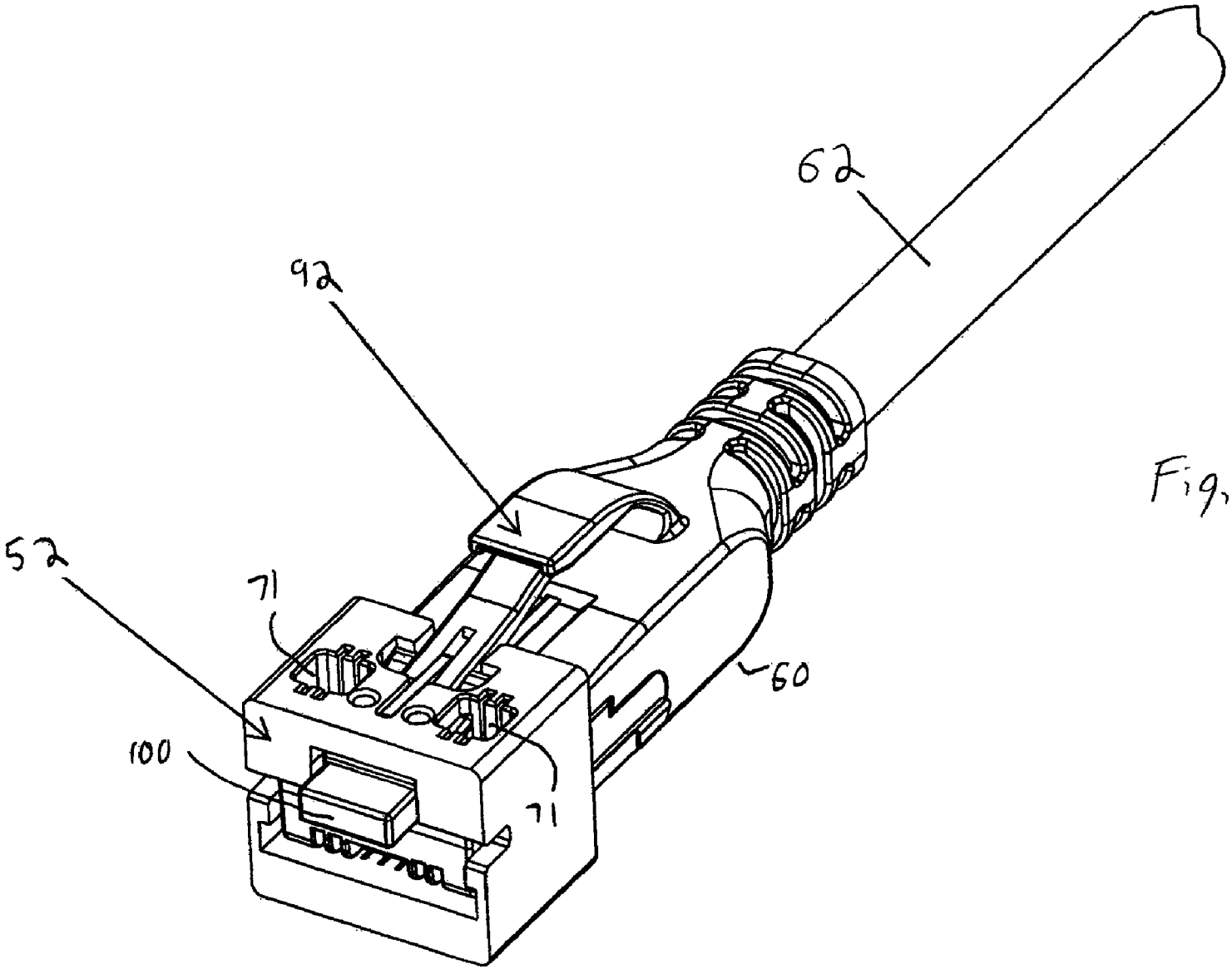
FIG. 10 is a top perspective view of a plug assembly system and cable in accordance with an embodiment of the invention.

Referring to FIGS. 3, 9 and 10, the assembly of a plug then includes a driving of contacts 68 through contact holder 52 into plug body 54, into channels 70 and then through wires 64. The channels 70 formed in shield 56 are thus aligned with respective contact slots 74 and position the wires to be terminated by contacts 68. The driving may be done by a piston using a hand tool or work bench tool (not shown) and provides both a mechanical and electrical connection between contacts 68 and wires 64. Tines of contacts 68 penetrate any insulation of wires 64. Once the driving is performed, and contacts 68 previously retained in contact holder 52 are inserted into plug body 54 to terminate wires 64, contact holder 52 is detached from plug body 54 and discarded. The views shown in FIGS. 11 and 12 show plug body 54 after contact holder 52 has been discarded. In prior art assemblies, contacts were frequently pre-inserted in the plug body itself. Such an arrangement is very difficult to use in high speed Category 7 plugs where contacts are disposed on both sides of a plug.

Having described the preferred embodiments of the invention, it should be noted that the scope of the invention is limited only by the scope of the claims attached hereto and obvious modifications may be made without departing from the scope and spirit of the invention.

What is claimed is:

1. A modular plug for terminating a cable including at least four twisted-pair of wires, comprising:

a plug body having a top and a bottom, a plurality of contact slots formed in said plug body, four slots formed in said top of said plug body, two of said top slots formed on a left side of said plug body and two of said top slots formed on a right side of said plug body, and four contact slots formed in said bottom of said plug body, two of said bottom slots formed on a left side of said plug body and two of said bottom slots formed a right side of said plug body;

a shield situated in said plug body for preventing cross-talk between respective pairs of wires, said shield including vertical upwardly and downwardly extending ribs and horizontal leftwardly and rightwardly extending ribs;

said vertical upwardly extending rib structured and arranged to provide cross-talk shielding between two of said wire pairs situated vertically above said horizontal extending ribs on left and right sides of said vertical upwardly extending rib respectively;

said vertical downwardly extending rib structured and arranged to provide cross-talk shielding between two of said wire pairs situated vertically below said horizontal extending ribs on left and right sides of said vertical downwardly extending rib;

said horizontal leftwardly extending rib structured and arranged to provide cross-talk shielding between two of said wire pairs situated vertically above and vertically below said horizontal leftwardly extending rib and to the left of said vertical upwardly and downwardly extending ribs; and said horizontal rightwardly extending rib structured and arranged to provide cross-talk shielding between two of said wire pairs situated vertically above and vertically below said horizontal rightwardly extending rib and to the right of said vertical upwardly and downwardly extending ribs.

2. A modular plug as recited in claim 1 wherein pairs of channels are formed in upper and lower sides of portions of each of said horizontal leftwardly and rightwardly extending ribs of said shield, each said pair of channels structured and arranged to receive respective pair of wires.

3. A modular plug as recited in claim 2 wherein each pair of channels is aligned with respective contact slots formed in said plug body.

4. A modular plug as recited in claim 1 wherein said shield further includes downwardly leftwardly and downwardly rightwardly rib portions extending from outer ends of said horizontal leftwardly and rightwardly extending ribs of said shield.

5. A modular plug as recited in claim 4 wherein pairs of channels are formed in upper and lower sides of each of said downwardly leftwardly and downwardly rightwardly extending rib portions; each of said pair of channels structured and arranged to receive a respective pair of wires and being aligned with respective contact slots formed in said plug body.

6. A contact insertion system for a modular plug having a plug body having four contact slots formed in a top of the plug body, two of said top slots formed in a left side of the plug body and two of said top slots formed in a right side of the plug body, and four contact slots formed in a bottom of the plug body, two of said bottom slots formed on a left side of the plug body and two of which are formed on a right side of the plug body, comprising:

a contact holder member including a body having a top and a bottom, four contacts movably retained in apertures formed in a top of the holder member body, two of said top contacts retained in apertures formed on a left side of said holder member body and two of said top contacts retained in apertures formed on a right side of said holder member body, and four contacts movably retained in a bottom of the holder member body, two of said bottom contacts movably retained in apertures formed on a left side of said holder member body and two of said bottom contacts movably retained in apertures formed on a right side of said holder member body; and said holder member body structured and arranged to receive said plug body so that said top and bottom contacts retained in said holder member body are aligned with said contact slots formed in said plug body.

7. A contact insertion system as recited in claim 6 wherein said contact holder member includes a cut-out structured and arranged to receive a protrusion formed on said plug body.

* * * * *